US007483773B1

(12) United States Patent
Tripp

(10) Patent No.: US 7,483,773 B1
(45) Date of Patent: Jan. 27, 2009

(54) SYSTEM AND METHOD FOR MONITORING AIRCRAFT FOR EXCESSIVE DEVIATION FROM FLIGHT REGIME

(75) Inventor: Karen C. Tripp, Cincinnati, OH (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 459 days.

(21) Appl. No.: 10/442,715

(22) Filed: May 21, 2003

(51) Int. Cl.
*G08G 5/04* (2006.01)

(52) U.S. Cl. ..... 701/3; 701/301; 342/29; 340/961; 340/970

(58) Field of Classification Search ..... 701/3, 701/4, 8, 9, 11, 14, 18, 24, 120, 301; 340/5.73, 340/988, 961, 970; 348/143; 244/118.5; 342/30, 29, 32, 173, 179, 181, 182; *G08G 5/04*
See application file for complete search history.

(56) References Cited

U.S. PATENT DOCUMENTS 5,528,244 A * 6/1996 Schwab ..... 342/37
5,570,095 A * 10/1996 Drouilhet et al. ..... 342/357.07
6,092,007 A * 7/2000 Cotton et al. ..... 701/4
6,205,376 B1 * 3/2001 Gordon ..... 701/4
6,275,172 B1 * 8/2001 Curtis et al. ..... 340/961
6,546,338 B2 * 4/2003 Sainthuile et al. ..... 701/301
6,675,095 B1 * 1/2004 Bird et al. ..... 701/301
6,681,158 B2 * 1/2004 Griffith et al. ..... 701/3
2002/0011950 A1 * 1/2002 Frazier et al. ..... 342/357.08
2002/0075179 A1 * 6/2002 Hudson et al. ..... 342/30
2002/0180631 A1 * 12/2002 Alon ..... 342/37
2002/0186163 A1 * 12/2002 Morchel et al. ..... 342/174
2003/0016144 A1 * 1/2003 Pattisapu ..... 340/945
2003/0016159 A1 * 1/2003 Stayton et al. ..... 342/30
2003/0128151 A1 * 7/2003 Ybarra et al. ..... 342/29
2005/0085959 A1 * 4/2005 Feyereisen ..... 701/14

* cited by examiner

*Primary Examiner*—Tuan C To

(57) ABSTRACT

The present invention relates to a system for detecting deviation from a normal flight regime. The system includes at least one aircraft information system located on an aircraft for detecting an aircraft condition variable, a processing system configured to determine whether the aircraft condition variable is within a predefined tolerance of a predefined normal status for that aircraft condition variable, the processing system including an output device configured to transmit a signal indicative of a deviation from the predefined normal status, and a communication system for communicating between the aircraft and an external receiving station.

7 Claims, 3 Drawing Sheets

SYSTEM AND METHOD FOR MONITORING AIRCRAFT FOR EXCESSIVE DEVIATION FROM FLIGHT REGIME

BACKGROUND OF THE INVENTION

The present invention relates generally to the field of aircraft monitoring systems and methods. More particularly, the present invention relates to a system and method for monitoring aircraft for excessive deviation from a flight regime using a data link communication channel.

Air travel is increasingly used by travelers as a preferred method of travel. Aircraft are being used by travelers, both business and leisure, to quickly and safely reach their destination. However, the increase in air travel has caused an increase in air traffic. Additionally, airlines are increasingly using aging aircraft fleets to meet the demand for space on airplanes and satisfy economic demands. As the skies become more crowded with aircraft, and with aging aircraft may be more likely to experience system failures, it is increasingly important to monitor and track aircraft to prevent collisions or to detect any deviation from expected behavior in an aircraft that may be caused by a system failure.

Additionally, recent events have shown that airplanes are susceptible to terrorist attack. Terrorists may take over an airplane and cause the plane to deviate from its designated course to become a weapon of destruction. It is important to track any deviations from expected behavior to have advanced warning of a possible terrorist incident.

Conventionally, radar systems are in use that can track airplanes equipped with either a Mode-C or Mode-S transponder. A Mode-C transponder is used to broadcast a signal to ground stations from an aircraft indicating that the type of aircraft and indicating its current location. A Mode-S transponder is used to broadcast a message to ground stations or other aircraft from the aircraft indicating the type of aircraft, its current location, its current altitude, and its current heading. Both are one-way communication links. The transponders do not receive messages from ground stations or other aircraft.

What is needed is a system and method for tracking airplanes or other aircraft that can be used to indicate deviations from an expected flight pattern. What is also needed is a system that can indicate deviation based on examination of any one of a plurality of status indicators for an aircraft. What is further needed is a system that can gather and coordinate information available from airplane information systems for transmission to a ground receiver.

SUMMARY OF THE INVENTION

One embodiment of the invention relates to a system for detecting deviation from a normal flight regime. The system includes at least one aircraft information system located on an aircraft for detecting an aircraft condition variable. The system also includes a processing system configured to determine whether the aircraft condition variable is within a predefined tolerance of a predefined normal status for that aircraft condition variable. The processing system includes an output device configured to transmit a signal indicative of a deviation from the predefined normal status. The system further includes a communication system for communicating between the aircraft and a receiving station located external to the aircraft.

Another embodiment of invention relates to a system for detecting deviation from a normal flight regime. The system includes a means for detecting an aircraft condition variable. The system also includes a means for comparing the aircraft condition variable to a predefined normal aircraft condition variable. Further, the system includes a means for transmitting a signal indicative of a deviation from a normal flight regime when the aircraft condition variable is within a predefined tolerance of the normal aircraft condition variable.

Yet another embodiment of the present invention relates to a method for detecting a deviation from a normal flight regime. The method includes receiving and storing in a computing system located on a airplane a value and a tolerance indicative of a normal aircraft condition. The method also includes comparing the value of the normal aircraft condition to a current aircraft condition variable received from an aircraft information system. Further, the method includes transmitting a signal indicative of a deviation from the normal aircraft condition to a receiver located outside the aircraft where the current aircraft condition variable is not within the tolerance from the normal aircraft condition.

BRIEF DESCRIPTION OF THE DRAWINGS

The invention will become more fully understood from the following detailed description, taken in conjunction with the accompanying drawings, wherein like reference numerals refer to like elements, and in which.

DETAILED DESCRIPTION OF THE PREFERRED EMBODIMENTS

A system for and method of detecting excessive deviation from a normal flight regime are described. In the following description, for the purposes of explanation, numerous specific details are set forth in order to provide a thorough understanding of the present invention. It will be evident, however, to one skilled in the art that the exemplary embodiments may be practiced without these specific details. In other instances, structures and device are shown in diagram form in order to facilitate description of the exemplary embodiments.

In at least one exemplary embodiment, a computer system is described which has a central processing unit (CPU) that executes sequences of instructions contained in a memory. More specifically, execution of the sequences of instructions causes the CPU to perform steps, which are described herein. The instructions may be loaded into a random access memory (RAM) for execution by the CPU from a read-only memory (ROM), a mass storage device, or some other persistent storage. In other embodiments, hardwired circuitry may be used in place of, or in combination with, software instructions to implement the functions described. Thus, the embodiments described herein are not limited to any particular source for the instructions executed by the computer system.

Figure 1:
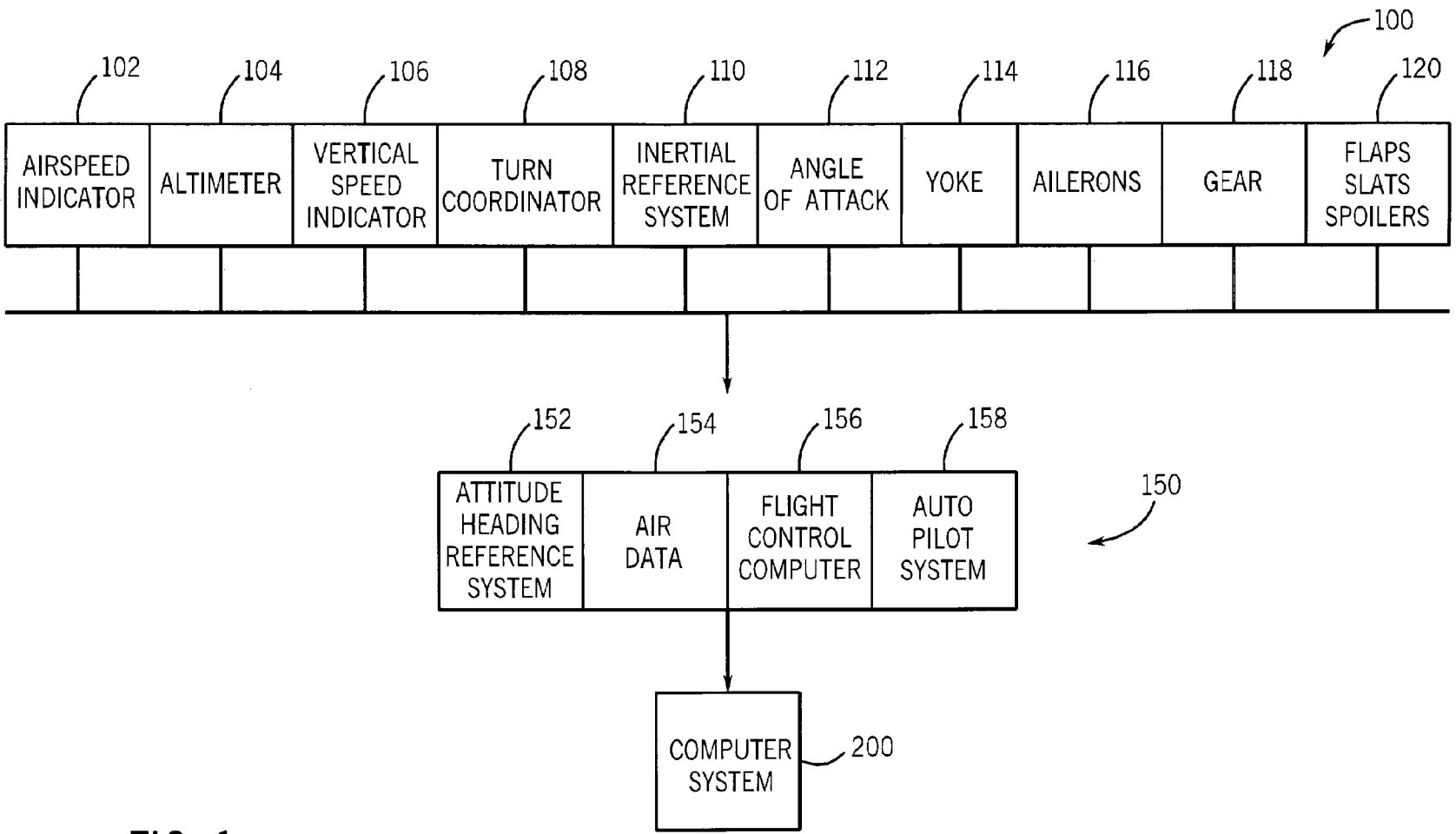
FIG. 1 is a block diagram illustrating a system for detecting deviations from a normal flight regime according to an exemplary embodiment.

Referring to FIG. 1, a block diagram illustrates aircraft navigation and equipment systems 100 coupled to aircraft status information processing systems 150 according to an exemplary embodiment. Navigation and equipment systems 100 and processing systems 150 can indicate a current aircraft status. Current aircraft status can include, but is not limited to, a position, an altitude, a heading, a rate of ascent, a rate of descent, an inertia, a turn rate, etc. According to alternative embodiment, the present invention could be used with more, less, or a plurality of navigation and equipment systems 100 shown in FIG. 1.

Airspeed indicator 102 may be a system for detecting the speed of an aircraft relative to the air in which it is flying. Altimeter 104 is an instrument for determining elevation, more particularly it may be an aneroid barometer used in aircraft that senses pressure changes accompanying changed in altitude. Vertical speed indicator 106 is a system to indicate the rate of ascent or descent of an aircraft. Turn coordinator 108 is an instrument for detecting the rate at which an airplane is turning. Inertial reference system 110 is an instrument for sensing and computing linear accelerations and angular turning rates about the roll, pitch and yaw axes. Angle of attack indicator 112 is used to measure the angle of attack, an aerodynamic parameter indicative of the angle between the chord line of the airfoil and the flight direction. Angle of attack indicator 112 can be a fully independent system or a system incorporating information from other systems. Yoke 114 is used to change the flight path of the aircraft and can provide feedback indicating that a change in course has been indicated. Ailerons 116 are two movable flaps on the wings of the airplane that can be used to control the plane's rolling and banking movements. Landing gear 118 is gear mounted to the underside of the aircraft that support the weight of the aircraft and its load and give it mobility on ground or water. Flaps, slats, and or spoilers 120 are long, narrow hinged plates on the upper and lower surface of an airplane wing that reduce lift and increase drag when raised. This list of equipment and systems is representative of the type of information available from aircraft systems, however, other types of information may be obtained and other equipment and systems may be used. Navigation and equipment systems 100 provide outputs indicative of the current status information for the aircraft.

The outputs from navigation and equipment systems 100 are received by aircraft processing systems 150. Processing systems 150 provide feedback to the pilots or systems of an aircraft and/or are capable of controlling the aircraft. Processing systems 150 can also be used to consolidate information received from the plurality of navigation and equipment systems 100.

Attitude and heading reference system 152 is a mid-level system that gathers information from navigation and equipment systems 100 to provide data for display to the cockpit. According to an exemplary embodiment, system 153 is a digital, all attitude inertial sensor unit that provides attitude and heading measurements as well as angular rates and linear accelerations in all three aircraft axes.

Air data 154 is a computer used to calculate navigation parameters such as barometer corrected altitude, computed airspeed, true airspeed, mach number, static air temperature, etc. The parameters are calculated using software inputs and data from navigation and equipment systems 100.

Flight control computer 156 is a computer that allows pilots to fly an aircraft with minimum effort. Computer 156 interfaces with sensors and navigation and equipment systems 100 that move control surfaces to keep the aircraft flying smoothly and safely.

Auto-Pilot system 158 is a computer that automatically maintains a preset course. The computer receives input from navigation and equipment systems 100 and outputs control signals to maintain the aircraft's position along the preset course.

The output from systems 150 may be provided to cockpit displays or aircraft control systems to aid in flying the aircraft. According to an exemplary embodiment, the output from systems 150 may also be output to a computer system 200 for detecting excessive deviations in the output from what is expected for a normal flight regime. Computer system 200 is described in further detail with reference to FIG. 2. Computer system 200 is shown as receiving output from processing systems 150, however, the output could alternatively be received directly from navigation and equipment systems 100.

Figure 2:
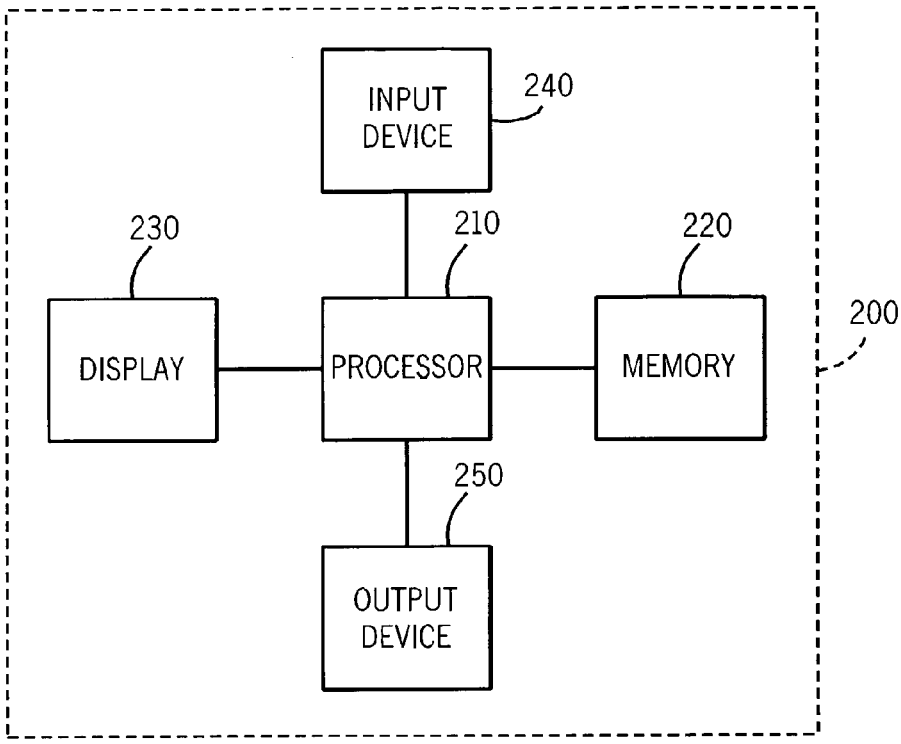
FIG. 2 is a block diagram of a computer system for detecting deviations from a normal flight regime according to an exemplary embodiment.

Referring now to FIG. 2, FIG. 2 illustrates a computer system 200 that can be used to determine the existence of excessive deviations from a normal flight regime. Computer system 200 can include a processor 210, a memory 220, a visual display unit 230, an input device 240, and an output device 250.

Computer system 200 can be any type of computing device, including data processing systems integrated with aircraft, workstations, laptops, notebooks, personal digital assistants (PDAs), or other equipment capable of receiving input from input device 240, accessing memory 220, executing a series of instructions and providing an output to visual display unit 230 or output device 250. Processor 220 can be any type of processor capable of executing instructions, such as an Intel® PENTIUM® processor sold by Intel Corp. of Santa Clara, Calif. Visual display unit 230 can be any type of visual display, such as a CRT tube monitor, an LCD display screen, or an avionics quality display. Input device 240 can be any apparatus for communicating information from navigation and equipment systems 100 or processing systems 150 to computer system 200. Output device 250 can be any type of output device capable of outputting a signal to indicate a deviation from a normal flight regime based on input received from input device 240. The signal may be an indicator of a deviation from a normal flight regime. According to an alternative embodiment, the signal may further include information received from navigation and equipment systems 100 and/or processing systems 150.

Computer system 200 can be included on the aircraft for receiving information from navigation and equipment systems 100 and processing systems 150. According to this exemplary embodiment, output device 240 can be a transponder or other communication device for broadcasting a signal indicating a deviation from a normal flight regime. According to an alternative embodiment, computer system 200 can be included in a receiving station, described below with reference to FIG. 3. According to this exemplary embodiment, input device 240 can be a receiver for receiving a signal broadcast from navigation and equipment systems 100 and/or processing systems 150.

Figure 3:
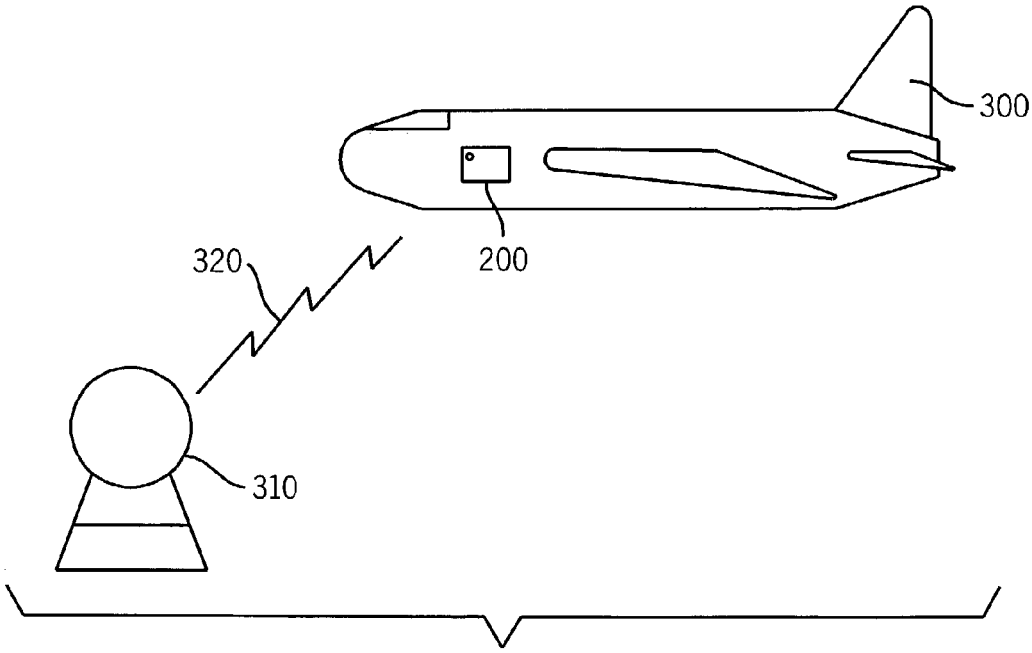
FIG. 3 a diagram illustrating a communication link between an aircraft and a receiving station for transmitting a signal indicative of a deviation from a normal flight regime according to an exemplary embodiment.

Referring now to FIG. 3, FIG. 3 illustrates an aircraft 300 including computer system 200 in communication with a receiving system 310 through a communication link 320. Communication link 320 between aircraft 300 and receiving system 310 can be accomplished using any datalink communication system. Communication link 320 can be a one-way communication link from aircraft 300 to receiving system 310 or a two way communication link. Communication link 320 can also be a broadcast signal sent from aircraft 300 to a plurality of receiving systems 310.

According to an exemplary embodiment, communication link 320 can be implemented on aircraft 300 using a modified mode-S transponder. Mode S is a datalink technology that uses discretely addressed interrogations. Mode S equipment includes ground stations with sensors and transponders aboard aircraft. The ground sensor periodically sends out interrogations signals that include the identification information for the aircraft. Accordingly, only the aircraft that matches the identification information will respond to the interrogation signal. Currently Mode S signals are of limited size and include only airplane status, position, altitude, and heading. The Mode-S signal would have to be modified to include more and/or differing information to indicate a deviation from a normal flight regime. Receiving system 310 is shown in FIG. 3 as a ground based system although, according to alternative embodiments, the system can be implemented on other aircraft, on oceanic vessels, on satellites, etc.

Figure 4:
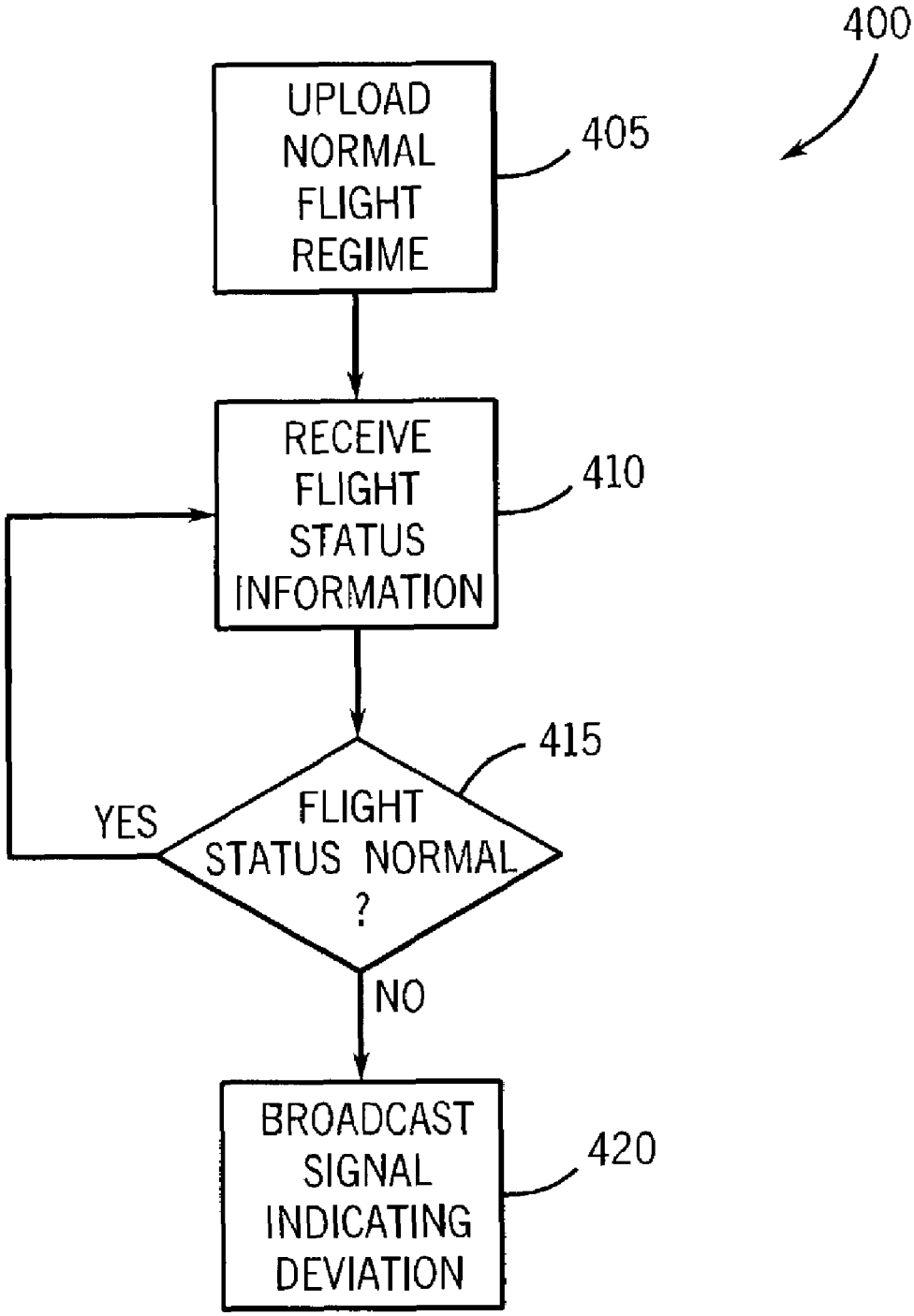
FIG. 4 is a flowchart illustrating a method for detecting deviations from a normal flight regime according to an exemplary embodiment.

Referring now to FIG. 4, FIG. 4 is a flowchart 400 illustrating a method of detecting deviations from a normal flight regime according to an exemplary embodiment.

In a step 405, a normal flight regime is uploaded to computer system 200. The normal flight regime can include a set of general tolerances. Examples can include, but are not limited to, a general tolerance can include a roll angle within a normal flight regime, a descent rate, or any other parameter with an associated tolerance. Alternatively, the normal flight regime may include a normal value with a tolerance indicative of acceptable deviations. For example, the normal flight regime shows the airplane should stay within a mile of a line indicative of the flight path. Additionally the normal flight regime can include a flight plan specific set of tolerances wherein information specific to an intended flight is uploaded. Examples can include, but are not limited to, a flight path with a deviation tolerance level can be uploaded, an altitude for the expected flight path, etc.

In a step 410 information is received indicating the current status of the aircraft. The information can be received from the navigation and equipment systems 150 and/or the processing systems 150.

The information can be compared to uploaded tolerances to determine if there has been any deviation from the normal flight regime in a step 415. This determination can be made continuously or periodically. If there is no deviation, step 410 can be repeated in a continuous loop.

If a deviation is detected, the deviation can be broadcast using communication link 320 in a step 420. The signal may be a warning signal indicating that a deviation has occurred. According to an alternative embodiment, the signal may be configured to contain all of the information available from navigation and equipment systems 100 and processing systems 150. The deviation can also be recorded to an aircraft's flight data recorded or cockpit voice recorder.

The broadcast can then be received by a receiving station. According to an exemplary embodiment, the receiving station can be a computer operator by an air traffic controller at an airport. According to alternative embodiments, the receiving station can be connected to any external point to communication the deviation and the need for possible action based on the deviation.

Advantageously, a receiving station external to the aircraft can be notified that a deviation has occurred. This notification enables faster response time to minimize risk for people on the aircraft or within the aircraft flight path. Also, the system can continue to broadcast information for the extent of time the aircraft was outside of the normal flight regime, allowing people on the ground to track the airplane more easily.

While the exemplary embodiments illustrated in the FIGURES and described above are presently preferred, it should be understood that these embodiments are offered by way of example only. For example, alternative embodiments include a computing system positioned within a receiving system receiving signals broadcast from navigation and equipment systems 100 and/or processing systems 150. Accordingly, the present invention is not limited to a particular embodiment, but extends to various modifications that nevertheless fall within the scope of the appended claims.

What is claimed is:

1. A system for detecting deviation from a normal flight regime, the system comprising:

at least one aircraft information system located on an aircraft for detecting an aircraft position variable;

a processing system on the aircraft configured to determine whether an aircraft condition variable is within a predefined tolerance of a predefined normal status for the aircraft condition variable, the processing system including an output device configured to transmit a signal indicative of a deviation from the predefined normal status; and a communication system configured to communicate the signal indicative of the deviation from the predefined normal status from the aircraft to a receiving station located external to the aircraft using a Mode-S transponder system and the signal indicative of the deviation from the predefined normal status is transmitted as a modified Mode-S signal.

2. The system of claim 1, wherein the aircraft information system includes at least one of an attitude heading reference system an air data computer, a flight control computer and an auto pilot system.

3. The system of claim 1, wherein the signal indicative of a deviation from the predefined normal status is broadcast using a VHF radio system.

4. The system of claim 1, wherein the signal indicative of the deviation from the predefined normal status includes the aircraft condition variable.

5. The system of claim 1, wherein the aircraft information system is a vertical speed indicator.

6. The system of claim 5, wherein the aircraft condition variable is a current rate of ascent for the aircraft.

7. The system of claim 1, wherein the processing system is part of the aircraft information system.

* * * * *